US005576171A

United States Patent [19]

Olm et al.

[11] Patent Number: 5,576,171

[45] Date of Patent: Nov. 19, 1996

[54] TABULAR GRAIN EMULSIONS WITH SENSITIZATION ENHANCEMENTS

[75] Inventors: Myra T. Olm, Webster; Richard L. Daubendiek; Joseph C. Deaton, both of Rochester; Donald L. Black, Webster; Timothy R. Gersey, Rochester; Joseph G. Lighthouse, Rochester; Xin Wen, Rochester; Robert D. Wilson, Rochester, all of N.Y.

[73] Assignee: Eastman Kodak Company, Rochester, N.Y.

[21] Appl. No.: 442,228

[22] Filed: May 15, 1995

[51] Int. Cl.[6] ..... G03C 1/035; G03C 1/09

[52] U.S. Cl. ..... 430/567; 430/604; 430/605

[58] Field of Search ..... 430/605, 567, 430/604

[56] References Cited

U.S. PATENT DOCUMENTS

| | | | |
|---|---|---|---|
| 4,435,501 | 3/1984 | Maskasky | 430/434 |
| 4,439,520 | 3/1984 | Kofron et al. | 430/434 |
| 4,471,050 | 9/1984 | Maskasky | 430/567 |
| 4,814,264 | 3/1989 | Kishida et al. | 430/567 |
| 5,462,849 | 10/1995 | Kuromoto et al. | 430/605 |
| 5,494,789 | 2/1996 | Daubendiek et al. | 430/567 |
| 5,503,970 | 4/1996 | Olm et al. | 430/567 |
| 5,503,971 | 4/1996 | Daubendiek et al. | 430/567 |
| 5,518,872 | 5/1996 | King et al. | 430/567 |

FOREIGN PATENT DOCUMENTS

| | | | |
|---|---|---|---|
| 0498302A1 | 8/1992 | European Pat. Off. | G03C 1/035 |
| 0515894A1 | 12/1992 | European Pat. Off. | G03C 1/035 |

OTHER PUBLICATIONS

*Research Disclosure* vol. 367, Nov. 1994, Item 36736.

*Primary Examiner*—Mark F. Huff
*Attorney, Agent, or Firm*—Carl O. Thomas

[57] ABSTRACT

A chemically and spectrally sensitized tabular grain emulsion is disclosed including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, and (f) exhibiting an average thickness in the range of from less than 0.3 μm to at least 0.07 μm.

It has been observed that photographic performance is enhanced when surface chemical sensitization sites include epitaxially deposited silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junction with the protrusions, (c) forming a face centered cubic crystal lattice, and (d) containing a speed enhancing dopant selected to provide shallow electron trapping sites.

13 Claims, No Drawings

TABULAR GRAIN EMULSIONS WITH SENSITIZATION ENHANCEMENTS

FIELD OF THE INVENTION

The invention relates to silver halide photography. More specifically, the invention relates to improved spectrally sensitized silver halide emulsions and to multilayer photographic elements incorporating one or more of these emulsions.

BACKGROUND

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed. The most highly controlled site depositions (e.g., corner specific epitaxy siting) and the highest reported photographic speeds reported by Maskasky I were obtained by epitaxially depositing silver chloride onto silver iodobromide tabular grains.

Maskasky I at column 26, lines 7 to 28, discloses various alternative dopants for the silver salt epitaxy and different effects which the dopants can provide.

Maskasky U.S. Pat. No. 4,471,050, hereinafter referred to as Maskasky II, discloses that nonisomorphic silver salts can be selectively deposited on the edges of silver halide host grains without relying on a supplemental site director. The nonisomorphic silver salts include silver thiocyanate, β phase silver iodide (which exhibits a hexagonal wurtzite type crystal structure), γ phase silver iodide (which exhibits a zinc blende type crystal structure), silver phosphates (including meta- and pyro-phosphates) and silver carbonate. None of these nonisomorphic silver salts exhibit a face centered cubic crystal structure of the type found in photographic silver halides—i.e., an isomorphic face centered cubic crystal structure of the rock salt type. In fact, speed enhancements produced by nonisomorphic silver salt epitaxy have been much smaller than those obtained by comparable isomorphic silver salt epitaxial sensitizations.

Shallow electron trapping (SET) site providing dopants for silver halide emulsions are disclosed in *Research Disclosure,* Vol. 367, November 1994, Item 36736.

RELATED PATENT APPLICATIONS

Daubendiek et al U.S. Pat. No. 5,494,789, (Daubendiek et al I) observed photographic performance advantages to be exhibited by ultrathin tabular grain emulsions that have been chemically and spectrally sensitized, wherein chemical sensitization includes an epitaxially deposited silver salt.

Daubendiek et al U.S. Pat. No. 5,503,971, (Daubendiek et al II) observed in addition to the photographic performance advantages of Daubendiek et al I improvements in speed-granularity relationships attributable to the combination of chemical sensitizations including silver salt epitaxy and iodide distributions in the host tabular grains profiled so that the higher iodide host grain concentrations occur adjacent the corners and edges of the tabular grains and preferentially receive the silver salt epitaxy.

Daubendiek et al U.S. Ser. No. 297,195, filed Aug. 26, 1994, commonly assigned, titled ULTRATHIN TABULAR GRAIN EMULSIONS WITH SENSITIZATION ENHANCEMENTS, (Daubendiek et al III) observes additional photographic advantages, principally increases in speed and contrast, to be realized when the iodide concentration of the silver halide epitaxy on silver iodobromide ultrathin tabular grains is increased.

Olm et al U.S. Pat. No. 5,503,970, observed an improvement on the emulsions of Daubendiek et al I, II and III in which a dopant is incorporated in the silver salt epitaxy.

Problem to be Solved

Notwithstanding the many advantages of tabular grain emulsions in general and the specific improvements to color photographic elements in which they are employed, there has remained an unsatisfied need for performance improvements in tabular grain emulsions heretofore unavailable in the art. Specifically, there has remained a need for tabular grain emulsions that produce a better relationship between speed and granularity, which can be taken in terms of increased speed, lower granularity, or a combination of both.

SUMMARY OF THE INVENTION

In one aspect this invention is directed to an improved radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) having an average thickness in the range of from less than 0.3 μm to at least 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions being located on up to percent of the surface area of the tabular grains, having a higher overall solubility than at least that portion of the tabular grains forming epitaxial junctions with the protrusions, forming a face centered cubic crystal lattice, and including a speed enhancing dopant comprised of a coordination complex that (a) displaces ions in the silver halide crystal lattice of the protrusions and exhibits a net valance more positive than the net valence of the ions it displaces, (b) contains at least one ligand that is more electronegative than any halide ion, (c) contains a metal ion having a positive valence of from +2 to +4 and having its highest energy electron occupied molecular orbital filled, and (d) has its lowest energy unoccupied molecular orbital at an energy level higher than the lowest energy conduction band of the silver halide crystal lattice forming the protrusions.

It has been observed quite surprisingly that the speed increases imparted to tabular grain emulsions by silver halide epitaxy can be further increased by employing dopants that are selected to provide shallow electron trapping sites within the silver halide epitaxy. This addresses the problem of the art of requiring tabular grain emulsions that exhibit better speed-granularity relationships that can be applied to obtaining higher speed, lower granularity or a combination of both.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional tabular grain emulsion in which the tabular grains (a) have {111} major faces;

(b) contain greater than 70 mole percent bromide and at least 0.25 mole percent iodide, based on silver;

(c) account for greater than 90 percent of total grain projected area;

(d) exhibit an average equivalent circular diameter (ECD) of at least 0.7 μm; and (e) have an average thickness in the range of from less than 0.3 μm to at least 0.07 μm.

Tabular grain emulsions satisfying criteria (a) through (e) are, apart from their sensitization, which is the subject of this invention, conventional. The following provide illustrative teachings of tabular grain emulsions satisfying these criteria:

Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,672,027;
Sugimoto et al U.S. Pat. No. 4,665,012;
Yamada et al U.S. Pat. No. 4,679,745;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Sutton et al U.S. Pat. No. 5,300,413;
Delton U.S. Pat. No. 5,310,644;
Chang et al U.S. Pat. No. 5,314,793;
Black et al U.S. Pat. No. 5,334,495;
Chaffee et al U.S. Pat. No. 5,358,840; and
Delton U.S. Pat. No. 5,372,927.

In referring to grains and emulsions containing more than one halide, the halides are named in their order of ascending concentration. For camera speed films it is generally preferred that the tabular grains contain at least 0.25 (preferably at least 1.0) mole percent iodide, based on silver. The tabular grains in the emulsions of the invention contain in all instances less than 10 mole percent iodide, preferably less than 6 mole percent iodide, and optimally less than 4 mole percent iodide. It is possible to include minor amounts of chloride ion in the tabular grains. For example, Delton U.S. Pat. No. 5,372,927, cited above, discloses tabular grain emulsions containing from 0.4 to 20 mole percent chloride and up to 10 mole percent iodide, based on total silver, with the halide balance being bromide.

The tabular grains accounting for at least 90 percent of total grain projected area contain at least 70 mole percent bromide and at least 0.25 mole percent iodide, based on silver. These tabular grains include silver iodobromide, silver iodochlorobromide and silver chloroiodobromide grains. All references to the composition of the tabular grains exclude the silver halide epitaxy.

The iodide within the tabular grains can be uniformly or non-uniformly distributed in any conventional manner. For example, the emulsions of Wilgus et al U.S. Pat. No. 4,434,226 and Kofron et al U.S. Pat. No. 4,439,520, cited above, illustrate conventional uniform iodide silver iodobromide tabular grain emulsions. The emulsions of Solberg et al U.S. Pat. No. 4,433,048 and Chang et al U.S. Pat. No. 5,314,793, cited above, illustrate specifically preferred non-uniform iodide placements in silver iodobromide tabular grains that increase photographic speed without increasing granularity. In the tabular grains of the emulsions of the present invention it is specifically preferred that at least the portions of the tabular grains extending between their {111} major faces that form an epitaxial junction with silver halide deposited as a chemical sensitizer contain a lower iodide concentration than the silver halide epitaxy. Most preferably the tabular grains contain a lower concentration throughout than the silver halide epitaxy, and, optimally, the tabular grains contain less total iodide that the silver halide epitaxy.

The tabular grains in the emulsions of the invention all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Tabular grain emulsions in which the tabular grains account for greater than 97 percent of total grain projected area are preferred. Most preferably greater than 99 percent (substantially all) of total grain projected area is accounted for by tabular grains. Emulsions of this type are illustrated, for example, by Tsaur et al and Delton, cited above. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD of at least 0.7 μm. The advantage to be realized by maintaining the average ECD of at least 0.7 μm is demonstrated in Tables III and IV of Antoniades et al U.S. Pat. No. 5,250,403, the disclosure of which is here incorporated by reference. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the tabular grain emulsions of the invention the tabular grains accounting for greater than 90 percent of total grain projected area exhibit a mean thickness in the range of from less than 0.3 to 0.07 μm. Emulsions with greater tabular grain thicknesses are taught by Kofron et al, cited above, to be useful for recording blue exposures, but they are definitely inferior for recording in the minus blue (i.e., green and/or red) portion of the spectrum. Efficient levels of imaging with lower silver requirements can be realized when average tabular grain thicknesses are maintained less than 0.3 μm and spectral sensitizing dyes are employed. When the tabular grains have a minimum mean thickness of at least 0.07 μm a much wider range of emulsion preparation procedures and conditions are available than are required to produce tabular grain emulsions with mean grain thicknesses of less than 0.07 μm.

Preferred tabular grain emulsions are those in which grain to grain variance is held to low levels. It is preferred that greater than 90 percent of the tabular grains have hexagonal major faces. Preferred tabular grain emulsions exhibit a coefficient of variation (COV) based on ECD of less than 25 percent, most preferably less than 20 percent. COV as herein employed is 100 times the quotient of the standard deviation ($\sigma$) of ECD divided by mean ECD.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in tabular grain emulsions of the invention can produce a significant increase in emulsion granularity. A conventional solution is to employ low COV emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to conventional tabular grain precipitation procedures to decrease selectively the size-frequency distribution of the tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of tabular grains having greater than mean ECD's (hereinafter referred to as the $>ECD_{av}$. grains) can be realized by modifying the procedure for precipitation of the tabular grain emulsions in the following manner: Tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320 (hereinafter referred to as Maskasky III), incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky III employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfate of one of the following formulae:

$$R—SO_2S—M \quad (I)$$

$$R—SO_2S—R^1 \quad (II)$$

$$R—SO_2S—Lm—SSO_2—R^2 \quad (III)$$

The chemical and spectral sensitizations of this invention improve upon the best chemical and spectral sensitizations disclosed by Maskasky I. In the practice of the present invention tabular grains receive during chemical sensitization epitaxially deposited silver halide forming protrusions at selected sites on the tabular grain surfaces. The protrusions exhibit a higher overall solubility than the silver halide forming at least those portions of the tabular grains that serve as epitaxial deposition host sites—i.e., that form an epitaxial junction with the silver halide being deposited. By higher overall solubility it is meant that the average solubility of the silver halides forming the protrusions must be higher than the mole fraction weighted average solubility of the silver halides forming the host portions of the tabular grains. The solubility products, Ksp, of AgCl, AgBr and AgI in water at temperatures ranging from 0° to 100° C. are reported in Table 1.4, page 6, Mees, *The Theory of the Photographic Process*, 3rd Ed., Macmillan, New York (1966). For example, at 40° C., a common emulsion preparation temperature, the solubility product of AgCl is 6.22×

$10^{-10}$, AgBr is $2.44\times10^{-12}$ and AgI is $6.95\times10^{-16}$. Because of the large differences of silver halide solubilities it is apparent that the epitaxially deposited silver halide must in the overwhelming majority of instances contain a lower iodide concentration than the portions of the host tabular grains on which epitaxial deposition occurs. Requiring the epitaxially deposited protrusions to exhibit a higher overall solubility than at least those portions of the tabular grains on which they are deposited reduces displacement of halide ions from the tabular grains, thereby avoiding degradation of the tabular configuration of the grains.

Maskasky I observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host tabular grains. It would be more precise to reference the higher chloride concentration in the silver halide protrusions to the chloride ion concentration in the epitaxial junction forming portions of the tabular grains, but this is not necessary, since the chloride ion concentrations of the tabular grains are contemplated to be substantially uniform (i.e., to be at an average level) or to decline slightly due to iodide displacement in the epitaxial junction regions.

Contrary to the teachings of Maskasky I, it is the specific observation of Daubendiek et al III that improvements in photographic speed and contrast can be realized by adding iodide ions along with silver and chloride ions to the tabular grain emulsions while performing epitaxial deposition. This results in increasing the concentration of iodide in the epitaxial protrusions above the low (substantially less than 1 mole percent) levels of iodide that migrate from the silver iodobromide host tabular grains during silver and chloride ion addition. Although any increase in the iodide concentration of the face centered cubic crystal lattice structure of the epitaxial protrusions improves photographic performance, it is preferred to increase the iodide concentration to a level of at least 1.0 mole percent, preferably at least 1.5 mole percent, based on the silver in the silver halide protrusions. The addition of bromide ions along with chloride and iodide ions increases the amounts of iodide that can be incorporated in the silver halide epitaxy while, surprisingly, increasing the level of bromide does not detract from the increases in photographic speed and contrast observed to result from increased iodide incorporations. The generally accepted solubilities of silver iodide in silver bromide and silver chloride is 40 and 13 mole percent, respectively, based on total silver, with mixtures of silver bromide and chloride accomodating intermediate amounts of silver iodide, depending on the molar ratio of Br:Cl. It is preferred that the silver iodide in the epitaxy be maintained at less than 10 mole percent, based on total silver in the epitaxy. It is further preferred that the overall solubility of the silver halide epitaxy remain higher than that of the portions of the tabular grains serving as deposition sites for epitaxial deposition. The overall solubility of mixed silver halides is the mole fraction weighted average of the solubilities of the individual silver halides.

It is believed that the highest levels of photographic performance are realized when the silver halide epitaxy contains both (1) the large differences in chloride concentrations between the host tabular grains and the epitaxially deposited protrusions noted above and (2) elevated levels of iodide inclusion in the face centered cubic crystal lattice structure of the protrusions.

Subject to the composition modifications specifically described above, preferred techniques for chemical and spectral sensitization can be similar to those described by Maskasky I, cited above and here incorporated by reference. Maskasky I reports improvements in sensitization by epitaxially depositing silver halide at selected sites on the surfaces of the host tabular grains. Maskasky I attributes the speed increases observed to restricting silver halide epitaxy deposition to a small fraction of the host tabular grain surface area. It is contemplated to restrict silver halide epitaxy to less than 50 percent of the tabular grain surface area and, preferably, to a greater extent, as taught by Maskasky I. Specifically, Maskasky I teaches to restrict silver halide epitaxy to less than 25 percent, preferably less than 10 percent, and optimally less than 5 percent of the host grain surface area. When the tabular grains contain a lower iodide concentration central region and a higher iodide laterally displaced region, as taught by Solberg et al and Daubendiek et al II, it is preferred to restrict the silver halide epitaxy to those portions of the tabular grains that are formed by the laterally displaced regions, which typically includes the edges and corners of the tabular grains.

When the iodide concentrations of different portions of the tabular grains differ, it is recognized that the iodide concentration of the epitaxial protrusions can be higher than the overall average concentration of the host tabular grains without risking disruption of the tabular grain structure, provided that the iodide concentrations of the portions of the tabular grains that provide the deposition sites of the epitaxial protrusions are higher than the iodide concentrations of the epitaxial protrusions.

Like Maskasky I, nominal amounts of silver halide epitaxy (as low as 0.05 mole percent, based on total silver, where total silver includes that in the host and epitaxy) are effective in the practice of the invention. Because of the increased host tabular grain surface area coverages by silver halide epitaxy discussed above and the lower amounts of silver in tabular grains, an even higher percentage of the total silver can be present in the silver halide epitaxy. However, in the absence of any clear advantage to be gained by increasing the proportion of silver halide epitaxy, it is preferred that the silver halide epitaxy be limited to 50 percent of total silver. Generally silver halide epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver halide epitaxy that can be applied in forming the emulsions of this invention. Maskasky I teaches employing spectral sensitizing dyes that are in their aggregated form of adsorption to the tabular grain surfaces capable of direct silver halide epitaxy to the edges or corners of the tabular grains. Cyanine dyes that are adsorbed to host tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the tabular grains is more efficient than that overlying all or most of the major faces, still better is epitaxy that is substantially confined to the edges of the host tabular grains, with limited coverage of their major faces, and still more efficient is epitaxy that is confined at or near the corners or other discrete sites of the tabular grains. The spacing of the corners of the major faces of the host tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain. When the host tabular grains contain a higher iodide concentration in laterally displaced regions, as taught by Solberg et al, it is recognized that enhanced photographic performance is realized by restricting silver halide protrusions to the higher iodide laterally displaced regions.

It is a specific recognition of this invention that improvements in photographic performance compatible with the advantages elsewhere described can be realized by incorporating a dopant capable of increasing photographic speed by forming shallow electron traps. When a photon is absorbed by a silver halide grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of $Ag^o$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the silver halide epitaxy to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics,* Vol. 37 (1988) p. 395 and *Excitonic Processes in Solids* by M. Ueta, H. Kansaki, K. Kobayshi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of metal ions in the spectrochemical series is apparent:

$$I^- < Br^- < S^{-2} < \underline{S}CN^- < Cl^- < NO_3^- < F^- < \underline{O}H < ox^{-2} < H_2O < NCS^- < CH_3CN^- < NH_3 < en < dipy < phen < \underline{N}O_2^- < phosph \ll \underline{C}N^- < \underline{C}O.$$

The abbreviations used are as follows: ox=oxalate, dipy= dipyridine, phen=o-phenathroline, and phosph =4-methyl-2, 6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < Fe^{+2} < Cr^{+3} \approx V^{+3} < CO^{+3} < Mn^{+4} < Mo^{+3} < Rh^{+3} \approx Ru^{+3} < Pd^{+4} < Ir^{+3} < Pt^{+4}$$

The metal ions in boldface type satisfy frontier orbital requirement (1) above. Although this listing does not contain all the metal ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experi-mental Techniques,* 2nd Ed., by Charles P. Poole, Jr. (1983) published by John Wiley & Sons., Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi*(b), Vol. 152 (1989), pp. 583–592, in a AgCl crystal the g factor of the electron EPR signal is 1.88 ±0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[11990]-249588, the disclosures of which are here incorporated by reference. Useful neutral and anionic organic ligands for hexacoordination complexes are disclosed by Olm et al U.S. Pat. No. 5,360,712, the disclosure of which is here incorporated by reference. Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980).

In a specific, preferred form it is contemplated to employ as a dopant a hexacoordination complex satisfying the formula:

$$[ML_6]^n \quad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[IrCl_4(oxalate)]^{-4}$ |
| SET-26 | $[In(NCS)_6]^{-3}$ |
| SET-27 | $[Ga(NCS)_6]^{-3}$ |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the tabular grains and the silver in the protrusions. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in the tabular grains and the remainder is incorporated in the silver halide protrusions; however, this is not preferred. The advantages of placing the dopant in the silver halide protrusions are (1) the risk of dopant contributing to thickening of the tabular grains is eliminated and (2) by locating the dopant in the protrusions it is placed near the site of latent image formation, which generally occurs at or near the junction of the protrusions with the tabular grains. Locating the dopant near the site of latent image formation increases the effectiveness of the dopant.

Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure* December 1989, Item 308119, Section III. Chemical sensitization. Kofron et al illustrates the application of these sensitizations to tabular grain emulsions.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

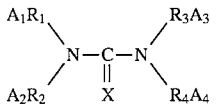

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. Maskasky I teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes are available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the tabular grain emulsions of the invention. The selection of J-aggregating blue absorbing spectral sensitizing dyes for use as site directors is specifically contemplated. A general summary of useful spectral sensitizing dyes is provided by *Research Disclosure,* December 1989, Item 308119, Section IV. Spectral sensitization and desensitization, A. Spectral sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an tabular grain according to the invention after chemical sensitization has been completed.

Aside from the features of spectral sensitized, silver halide epitaxy sensitized tabular grain emulsions described above, the emulsions of this invention and their preparation can take any desired conventional form. For example, in accordance with conventional practice, after a novel emulsion satisfying the requirements of the invention has been prepared, it can be blended with one or more other novel emulsions according to this invention or with any other conventional emulsion. Conventional emulsion blending is illustrated in *Research Disclosure,* Item 36544, Section I, E. Blends, layers and performance categories, the disclosure of which is here incorporated by reference.

The emulsions once formed can be further prepared for photographic use by any convenient conventional technique. Additional conventional features are illustrated by *Research Disclosure* Item 36544, cited above, Section II, Vehicles, vehicle extenders, vehicle-like addenda and vehicle related addenda; Section III, Emulsion washing; Section V, Spectral sensitization and desensitization; Section VI, UV dyes/optical brighteners/luminescent dyes; Section VII, Antifoggants and stabilizers; Section VIII, Absorbing and scattering materials; Section IX, Coating physical property modifying addenda; Section X, Dye image formers and modifiers. The features of Sections VI, VIII, IX and X can alternatively be provided in other photographic element layers. Other features which relate to photographic element construction are found in Section XI, Layers and layer arrangements; XII, Features applicable only to color negative; XIII, Features applicable only to color reversal; XIV, Scan facilitating features; and XV, Supports.

The novel epitaxial silver halide sensitized tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention. Photographic speeds are reported as relative log speeds, where a speed difference of 30 log units equals a speed difference of 0.3 log E, where E represents exposure in lux-seconds. Contrast is measured as mid-scale contrast. Halide ion concentrations are reported as mole percent (M%), based on silver.

Emulsion A

This emulsion was precipitated in a two part process. Part 1 effected the formation of nine moles of a Ag(Br, I) emulsion having mean diameter and thickness values of ca. 1.9 μm and 0.047 μm, respectively. A portion of this emulsion was then used as a seed emulsion for further growth in Part 2, during which additionally precipitated silver bromide was deposited mainly on the {111} major faces of the tabular grains—i.e., thickness rather than lateral growth was fostered in Part 2 of the precipitation.

Part 1

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous, 4 second addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ ($2KHSO_5.KHSO_4.K_2SO_4$, purchased from Aldrich) in 50 mL of water, and the temperature was raised to 54° C. in 9 min. After the reactor and its contents were held at this temperature for 9 min, 100 g of oxidized methionine lime-processed bone gelatin dissolved in 1.5 L $H_2O$ at 54° C. were added to the reactor. Next the pH was raised to 5.90, and 43.75 mL of 2.8M NaBr were added to the reactor. Twenty five minutes after nucleation the growth stage was begun during which 2.5 M $AgNO_3$, 2.8M NaBr, and a 0.108M suspension of AgI (Lippmann) were added in proportions to maintain (a) a uniform iodide level of 4.125M % in the growing silver halide crystals and (b) the reactor pBr at the value resulting from the cited NaBr additions prior to the start of nucleation and growth, until 0.813 mole of silver iodobromide had formed, at which time the excess $Br^-$ concentration was increased by addition of 37.5 mL of 2.8M NaBr; the reactor pBr was maintained at the resulting value for the balance of the growth. The flow of the cited reactants was then resumed and the flow was accelerated such that the final flow rate at the end of growth, which took at total of 127 minutes, was approximately 13 times that at the beginning; a total of 9 moles of silver iodobromide (4.125M %I) was formed.

Part 2

Six moles of the emulsion formed in Step 1 were removed, and additional growth was carried out on the 3 moles which were retained in the reactor and which served as seed crystals for further thickness growth. Before initiating this additional growth, 34 grams of oxidized, lime-processed bone gelatin, dissolved in 500 mL water at 54° C., were added and the reactor pBr was adjusted to ca. 2.05 by slow addition of $AgNO_3$. Next, growth was begun using double jet addition of 3.0M $AgNO_3$ and 5.0M NaBr with relative rates such that the reactor pBr was further adjusted to 3.3 over the next 10 min. While maintaining this high pBr value and a temperature of 54° C., growth was continued by adding the cited $AgNO_3$ and NaBr solutions until an additional 9.0 moles of silver bromide was deposited onto the host grains; flow rates were accelerated 1.85 x during the 162 min growth of Part 2.

The final overall composition of the resulting silver iodobromide tabular grain emulsion was ca. 98.97M % Br and 1.03M % I. When growth was completed, pBr was lowered to ca. 2, and the emulsion was coagulation washed. After washing, pH and pBr were adjusted to 6.0 and 3.1, respectively, prior to storage.

The resulting emulsion was examined by scanning electron microscopy (SEM) and mean grain area was determined from the resulting grain pictures using a *Summagraphics SummaSketch Plus* sizing tablet that was interfaced to an IBM Personal Computer: More than 98% of total grain projected area were provided by tabular crystals. The mean ECD of the emulsion grains was 1.37 gm (coefficient of variation=43). During Part 2 the mean ECD of the tabular grain emulsion was actually reduced from its value at the end of Part 1. Assuming a constant number of particles, this indicated that negative lateral growth occurred, suggesting that ripening had occurred at the edges of the tabular grains and that deposition of silver halide had occurred primarily on the {111} major faces of the tabular grains. Since the grain population of the final emulsion consisted almost exclusively of tabular grains, the grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole cm and its site area per molecule to be 0.566 $nm^2$. This approach gave a mean grain thickness of 0.175 μm.

Epitaxial Sensitizations

Samples of the emulsions were next sensitized with and without silver salt epitaxy being present.

Control

A 0.5 mole sample of Emulsion A was melted at 40° C. and its pBr was adjusted to ca. 4 with a simultaneous addition of $AgNO_3$ and KI solutions in a ratio such that the small amount of silver halide precipitated during this adjustment was 12% I. Next, 2M % NaCl (based on the original amount of silver iodobromide host) was added, followed by addition of spectral sensitizers Dye 1 [anhydro-9-ethyl-5',6'-dimethyoxy-5-phenyl-3'-(3-sulfopropyl)-3-(3-sulfobutyl)oxathiacarbocyanine hydroxide] and Dye 2 [anhydro-5,5'-dichloro-9-ethyl-3,3'-bis(3-sulfopropyl)thiacarbocyanine hydroxide, sodium salt], after which epitaxy was formed by sequential additions $CaCl_2$, NaBr, AgI and $AgNO_3$. This procedure produced epitaxial growths mainly on the corners and edges of the host tabular grains. The epitaxy amounted to 6M % of the silver in the starting tabular grain emulsion. The nominal composition of the tabular grain host—that is, the halide added to form the host grains, and the actual composition of the host grains are set out in Table I. The nominal composition of the epitaxy and the actual composition of the epitaxy are set out in Table II.

Analytical electron microscopy (AEM) techniques were employed to determine the actual as opposed to nominal (input) compositions of the silver halide epitaxial protrusions. The general procedure for AEM is described by J. I. Goldstein and D. B. Williams, "X-ray Analysis in the TEM/STEM", *Scanning Electron Microscopy*/1977; Vol. 1, IIT Research Institute, March 1977, p. 651. The composition of an individual epitaxial protrusion was determined by focusing an electron beam to a size small enough to irradiate only the protrusion being examined. The selective location of the epitaxial protrusions at the corners of the host tabular grains facilitated addressing only the epitaxial protrusions. Each corner epitaxial protrusion on each of 25 grains was examined for each of the sensitizations. The results are summarized in Table I.

TABLE I

| | Halide in Tabular Grains | | | |
|---|---|---|---|---|
| | Halide | Halide Found (Std. Dev.) | | |
| Sample | Added | Cl | Br | I |
| Cont. | Br 99%<br>I 1% | 4.6%<br>(0.4) | 93.9%<br>(0.6) | 1.5%<br>(0.2) |

TABLE II

| | Halide in Epitaxy | | | |
|---|---|---|---|---|
| | Halide | Halide Found (Std. Dev.) | | |
| Sample | Added | Cl | Br | I |
| Cont. | Cl 42%<br>Br 42%<br>I 16% | 39.8%<br>(9.9) | 54.6%<br>(9.1) | 5.6%<br>(1.6) |

The minimum AEM detection limit was a halide concentration of 0.5M %.

Example 1

The preparation procedure employed in preparing the Control was repeated, except that $K_4Ru(CN)_6$ in the amount of $4\times10^{-5}$ mole per mole Ag forming the host grains was introduced during formation of epitaxy as a separate aqueous solution, added between NaBr and AgI additions.

Post-Epitaxy Preparation

The epitaxially sensitized emulsions were each divided into smaller portions to determine optimal levels of subsequently added sensitizing components and to test effects of level variations. To these portions were added additional portions of Dyes 1 and 2, 60 mg NaSCN/mole Ag, sulfur Sensitizer 1, gold Sensitizer 2, and 11.44 mg 1-(3-acetamidophenyl)-5-mercaptotetrazole (APMT)/mole Ag. After all components were added the mixture was heated to 50° C. to complete the sensitization, and after cool-down, 114.4 mg additional APMT was added.

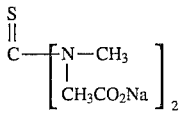

Sensitizer 1

-continued

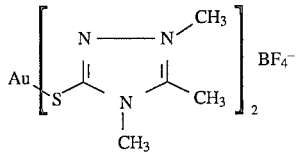

Sensitizer 2

Based on photographic element constructions and sensitometric evaluations identical to those reported below using portions of the emulsions, the optimum levels of Dyes 1 and 2 in each of the Control and Example 1 emulsions were determined to be 87.7 and 358.7 mg/mole Ag, respectively. Optimum levels of Sensitizers 1 and 2 in mg/mole Ag were determined to be 2.7 and 0.8 (Control) and 3.1 and 0.95 (Example 1), respectively.

The resulting optimally sensitized emulsions were coated on a cellulose acetate film support over a gray silver antihalation layer, and the emulsion layer was overcoated with a 4.3 g/m$^2$ gelatin layer containing surfactant and 1.75 percent by weight, based on total weight of gelatin, of bis(vinylsulfonyl)methane hardener. Emulsion laydown was 0.646 g Ag/m$^2$ and this layer also contained 0.323 g/m$^2$ and 0.019 g/m$^2$ of Couplers 1 and 2, respectively, 10.4 mg/m$^2$ of 4-hydroxy -6-methyl-1,3,3a,7-tetra azaindene ($Na^+$ salt), and 14.4 mg/m$^2$ 2-(2-octadecyl)-5-sulfohydroquinone ($Na^+$ salt), surfactant and a total of 1.08 g gelatin/m$^2$.

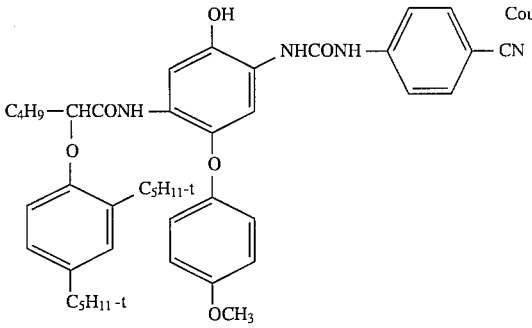

Coupler 1

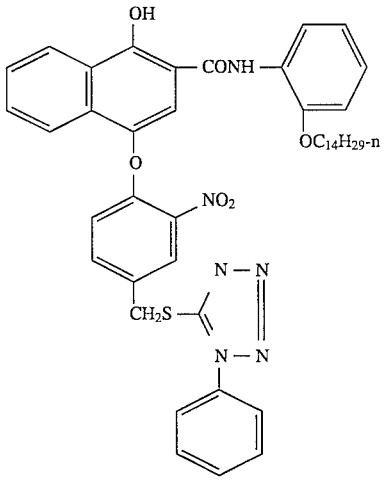

Coupler 2

Sensitometry

The emulsions so coated were given 0.01 sec Wratten 23A ™ filtered (wavelengths >560 nm transmitted) daylight balanced light exposures through a calibrated neutral step tablet, and then were developed using the color negative Kodak Flexicolor™ C41 process. Speed was measured at a density of 0.15 above minimum density.

Granularity measurements were made according to the procedures described in the *SPSE Handbook of Photographic Science and Engineering*, W. Thomas, Ed., pp.

934–939. The granularity readings at each step were divided by the gamma (ΔD÷Δlog E, where D=density and E=exposure in lux-seconds) at each step and plotted vs. log E. In these plots there is typically a minimum. The minimum of this gamma-normalized granularity allows a comparison of coatings having differing contrast. Lower values indicate lower granularity. Granularity readings reported were averages of observations from four adjacent exposure steps near the speed point and extending to higher exposure levels. These four readings were typically near the minimum granularity.

The contrast normalized granularities obtained as described above are reported in Table III below in grain units (g.u.), in which each represents a 5 percent change; positive and negative changes correspond to grainier and less grainy images, respectively. In other words, negative differences in granularity, indicate granularity reductions.

The results are summarized in Table III.

TABLE III

| Sample | Dmin | Relative Log Speed | Midscale Contrast | Δ Normalized Granularity (g.u.) |
|---|---|---|---|---|
| Cont. | 0.14 | 100 | 0.58 | Check |
| Ex. 1 | 0.15 | 109 | 0.55 | 0.6 |

From Table III it is apparent that adding a shallow electron trapping site providing dopant in the epitaxy increased photographic speed without a corresponding increase in granularity. Applying the generally accepted standard that each increase of 30 speed units costs an increase of 7 g.u., it is noted that the Example 1 emulsion exhibited a speed advantage over the control of 9 speed units with only a 0.6 g.u. increase, rather than the 2.1 g.u. increase that would have been predicted. Thus, the presence of the shallow electron trapping site providing dopant offered a significant improvement in performance.

The invention has been described in detail with particular reference to preferred embodiments thereof, but it will be understood that variations and modifications can be effected within the spirit and scope of the invention.

What is claimed is:

1. A radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness in the range of from less than 0.3 μm to at least 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions being located on up to 50 percent of the surface area of the tabular grains, having a higher overall solubility than at least that portion of the tabular grains forming epitaxial junctions with the protrusions, forming a face centered cubic crystal lattice, and including a speed enhancing dopant comprised of a coordination complex that (a) displaces ions in the silver halide crystal lattice of the protrusions and exhibits a net valance more positive than the net valence of the ions it displaces, (b) contains at least one ligand that is more electronegative than any halide ion, (c) contains a metal ion having a positive valence of from +2 to +4 and having its highest energy electron occupied molecular orbital filled, and (d) has its lowest energy unoccupied molecular orbital at an energy level higher than the lowest energy conduction band of the silver halide crystal lattice forming the protrusions.

2. An emulsion according to claim 1 wherein the protrusions contain at least a 10 mole percent higher chloride concentration than the tabular grains.

3. An emulsion according to claim 2 wherein the protrusions contain at least a 20 mole percent higher chloride ion concentration than said tabular grains.

4. A radiation-sensitive emulsion according to claim 2 wherein the protrusions contain at least 1.0 and less than 10 mole percent iodide, based on silver in the protrusions.

5. An emulsion according to claim 1 where the epitaxially deposited silver halide protrusions are located on less than 25 percent of the tabular grain surfaces.

6. An emulsion according to claim 5 wherein the epitaxially deposited silver halide protrusions are predominantly located adjacent at least one of the edges and corners of the tabular grains.

7. An emulsion according to claim 1 wherein the metal ion is chosen from among $Fe^{+2}$, $Ru^{+2}$, $Os^{+2}$, $Co^{+3}$, $Rh^{+3}$, $Ir^{+3}$, $Pd^{+4}$ and $Pt^{+4}$.

8. A radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness in the range of from less than 0.3 μm to at least 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junctions with the protrusions, protrusions including at least a 10 mole percent higher chloride concentration than the tabular grains and an iodide concentration ranging from at least 1 to less than 10 mole percent, based on silver forming the protrusions, (c) forming a face centered cubic crystal lattice, and (d) including a speed enhancing dopant comprised of a divalent Group 8 dopant chosen from among $Fe^{+2}$, $Ru^{+2}$ and $Os^{+2}$ and at least one ligand more electron withdrawing than fluoride ion.

9. An emulsion according to claim 8 wherein the speed enhancing dopant is comprised of $Os^{+2}$ and at least one cyano ligand.

10. An emulsion according to claim 8 wherein the speed enhancing dopant is comprised of $Ru^{+2}$ or $Os^{+2}$ and at least three cyano ligands.

11. An emulsion according to claim 8 wherein the speed enhancing dopant is comprised of $Fe^{+2}$, $Ru^{+2}$, or $Os^{+2}$ and at least five cyano ligands.

12. A radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness in the range of from less than 0.3 μm to at least 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junctions with the protrusions and containing at least a 10 mole percent higher chloride concentration than the tabular grains, (c) forming a face centered cubic crystal lattice, and (d) including as a speed enhancing dopant a coordination complex of a metal ion chosen from among $Rh^{+3}$, $Ru^{+3}$, $Pd^{+4}$, $Ir^{+3}$, $Os^{+3}$ and $Pt^{+4}$ and ligands at least 3 of which are cyano ligands with any remaining ligand or ligands being a halide ligand.

13. An emulsion according to claim 12 wherein the coordination complex contains 6 cyano ligands.

* * * * *